United States Patent [19]

Weisser

[11] 3,973,868

[45] Aug. 10, 1976

[54] SUCTION VALVE FOR SUBMERGED PUMPING SYSTEM

[75] Inventor: German Louis Weisser, Huntington Beach, Calif.

[73] Assignee: Fairchild Industries Inc., Germantown, Md.

[22] Filed: Sept. 20, 1974

[21] Appl. No.: 507,752

[52] U.S. Cl. ..... 415/157; 415/158; 417/360; 417/901

[51] Int. Cl.[2] ..... F04D 27/00

[58] Field of Search ..... 417/901, 360; 415/158, 415/201, 157

[56] References Cited

UNITED STATES PATENTS 1,683,567 9/1928 Moody ..... 415/158 X 3,369,715 2/1968 Carter ..... 222/333

*Primary Examiner*—Robert B. Reeves
*Assistant Examiner*—John P. Shannon
*Attorney, Agent, or Firm*—Michael W. York

[57] ABSTRACT

A suction of fluid control valve for a submerged type pump for storage containers containing cryogenic fluids. The valve is normally open and includes a fluid control valve member having ports for communicating with the liquid stored in the storage container. A gas source is provided for producing relative movement between the valve members for sealing off the fluid ports and exposing the ports to thereby control the flow of the stored liquid into the pump housing.

5 Claims, 2 Drawing Figures

SUCTION VALVE FOR SUBMERGED PUMPING SYSTEM

Figure 1:
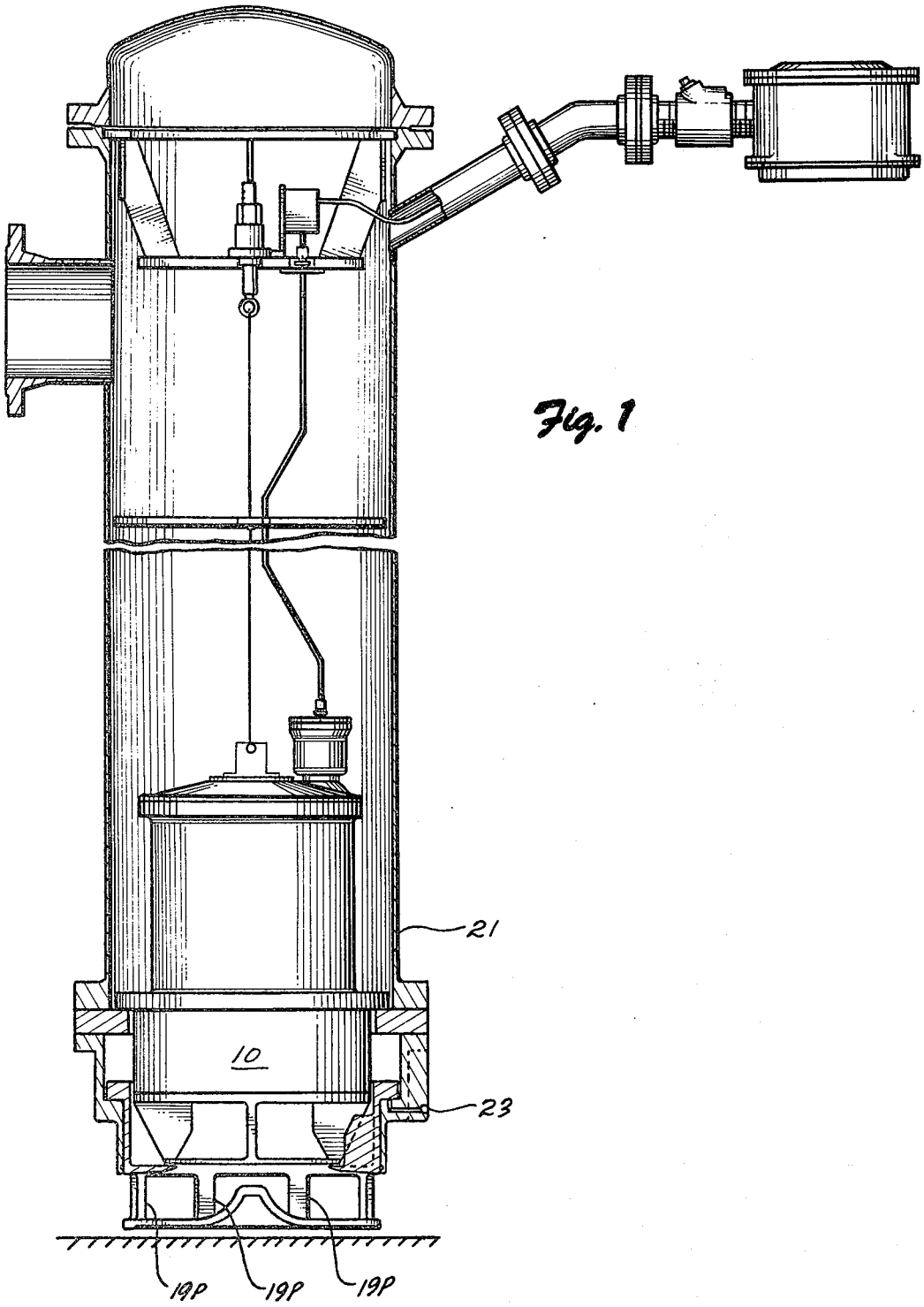

This invention relates to an improved submerged pumping system to retrieve an inoperative pump of the submerged type from an enclosed storage tank containing liquefied gas such as natural gas, propane, butane, etc.

At the present time there is known to the art submergible pumping systems especially adapted for cryogenic storage systems. These systems are disclosed in U.S. Pat. Nos. 3,543,964; 3,369,715 and 3,112,049. These patents represent the state of the art for the systems and apparatus presently used in the cryogenic industry. In general, the prior art type systems use casing valves which isolate the internal portion of the casing from the liquid in the storage tank and which valve is a mechanical spring loaded type. The construction of these casing valves may be better appreciated by referring to FIG. 7 of U.S. Pat. No. 3,369,715, or FIG. 2 of U.S. Pat. No. 3,453,964. These prior art casing valves are normally closed and are opened or are actuated by the weight of the pump acting against the spring when the pump is lowered into position. These valves generally contain frustroconical surfaces for the purpose of guiding the pump into proper location and to provide a seal on the frustroconical surface against leakage of the higher pressure liquid in the casing back into the storage tank once the pump is operating. The casing valve also generally contains a ring seal located in the lower outer flange section that is compressed by means of cylindrical helical springs and/or the pressure over the valve poppet as generated by the height of the liquid column in the storage tank. Although these prior art systems allow filling of the tank through the discharge casing, the casing valve is normally closed and during filling the force of the spring must be overcome. These springs do not have uniform spring forces and therefore undesirable chattering or vibration may be present during this operation which may damage the valve. These prior art pumping systems also generally include a pump retrieval mechanism at the upper portion of the casing to lift the pump and the electrical supply cables out of the casing.

The present invention provides an improved suction valve for a submerged pumping system for cryogenics in combination with a casing and retrieving mechanism for the submerged pump. The suction valve arrangement of the present invention is operated pneumatically by means of a gas which liquefies at a lower temperature than the liquid in the storage tank. For example, if the storage tank liquid is a liquefied natural gas then the gas used to operate the valve might be nitrogen since it liquefies at a temperature of −320° F. while the liquid natural gas has a boiling point of −260° F. at approximately atmospheric pressure. The system of the present invention also simplifies the deck penetrations at the top of the casing so that only a single mechanical seal against atmosphere is required thereby reducing the sources of undesirable leakages to a minimum.

From a structural standpoint, the present invention comprehends an assembly for pumping cryogenic fluids from storage tanks and permitting removal of pumping equipment comprising a single fluid transmitting casing extending from the top to the bottom portions of a storage tank and having a fluid outlet adjacent the top portion of the casing. The pump and motor unit is suspended from the top of the casing adjacent the bottom of the casing. Means are also provided for lifting a pump and motor unit from the bottom of the casing. The casing is provided with valve means arranged adjacent the bottom of the casing for controlling the flow of the stored fluid into the casing for pumping through to the casing fluid outlet and operable between a normally open position and a closed position. The valve means comprises a fluid control member in the form of a cylinder closed at the lower end having a plurality of fluid ports for conveying fluids into the pump and motor unit and a valve body constructed integral with the casing. One of the valve members is movable relative to the other member for blocking the fluid ports of the fluid control member to seal off the fluid ports and thereby close the valve. The valve means may also include means for guiding the pump into the proper location centrally of the valve. Pneumatic means is provided for producing relative movement between the valve members to operate the valve means between its open and closed positions for controlling the flow of stored fluid into the casing and through the fluid outlet.

Figure 2:
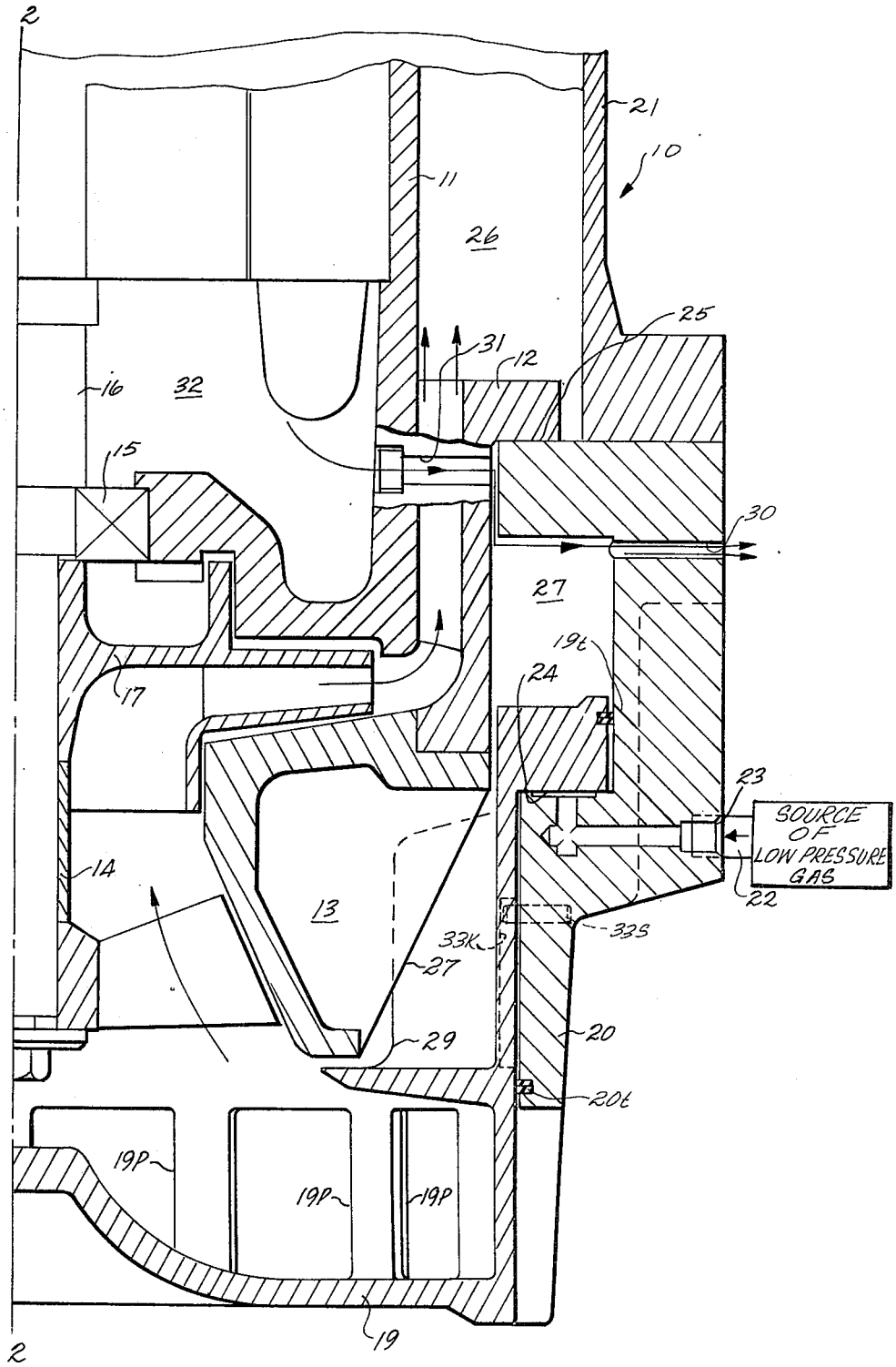

These and other features of the present invention may be more fully appreciated when considered in the light of the following specification and drawings, in which:

FIG. 1 is a broken vertical elevational view of the submerged pump assembly for pumping fluids from storage containers and embodying the invention, and FIG. 2 is a partial sectional view of the submerged pump assembly illustrated on one side of the center line 2—2 in accordance with the illustration of FIG. 1 and in operative condition.

The submerged pump assembly 10 comprises an electric motor housing 11, pump housing 12 and a suction housing 13. The rotating assembly 14 is maintained in position by means of a bearing 15 and is mounted to be rotatable with the motor shaft 16. The rotating assembly 4 mounts a pump impeller 17 and inducer 18 arranged outwardly of the impeller adjacent the fluid control or suction valve. The fluid control valve comprises a sliding valve section 19 having a plurality of fluid control ports 19P for controlling the flow of fluid into the pump assembly. The pump assembly is illustrated in FIG. 2 in its operating condition wherein the fluid ports 19P are unsealed to convey the fluid into the pumping assembly. In this condition the stored fluid is conveyed through the ports 19P to be operated on by the inducer 18 and pump impellers 17 to be pumped through to the discharge tube or casing 21. In its other operating condition, the sliding valve section 19 is moved upwardly from the position illustrated in FIG. 2 to cause the ports 19P to be blocked or sealed against the stationary valve body 20 thereby preventing the fluid from the storage tank to enter the motor and pump assembly and be pumped therethrough.

The liquid suction or control valve may be operated to its closed position through the application of a suitable source of low pressure gas conveyed through a conduit 22 connected to the port 23 constructed within the main valve body 20. The source of low pressure gas in the applications wherein a liquefied natural gas (LNG) is stored in the storage tank may be a nitrogen gas that is conveyed through the port 23. The specifications for the gas to pneumatically operate the suction or fluid control valve is that the gas applied to the port 23 should have a liquefaction temperature that is lower than the liquefaction temperature of the liquid in the storage tank. This is true in the case of a storage tank having liquefied natural gas since its boiling point is −260° F. at or adjacent atmospheric pressures and the nitrogen gas has a liquefaction temperature of −320° F. The gas applied through the port 23 acts on a flange section 24 which is provided with a sufficient area to produce the necessary lifting force for moving the valve element 19 upwardly. This lifting force should be greater than the static weights of the pump and valve element combined. A seal 25 is provided between the high pressure side of the valve or the side 26 to below the low pressure side 27 to prevent leakage from the high pressure side 26 to the low pressure side 26. In addition, guiding ribs 27 are provided in the pump suction housing 13 to properly locate the pump in a center position of the valve. The movable or slidable portion of the valve 19 is also provided with protrusion 29 to guide the pump into its proper location and to prevent the pump from rotating when it is actuated. The protrusions 28 are effective to counteract the starting torque of the motor.

The valve structure also includes a passage 30 to vent coolant, lubrication flow and gas from being dumped into the low pressure cavity 27 by the electrical motor. The passage 30 is located in the valve housing 20 and coacts with the passage 31 incorporated in the pump diffuser housing in between or through the actual diffuser vanes to communicate with the interior 32 of the housing for the electrical motor and the low pressure valve cavity 27 for the disposal of coolant and lubrication fluid out of the valve housing 20, as illustrated.

The main valve body 20 includes sealing means such as the teflon seal 20t arranged in the stationary body 20 adjacent the lower end thereof as illustrated. Similarly, a teflon seal 19t is arranged to be carried by the movable valve element 19 adjacent its upper end, as best illustrated in FIG. 2.

Since there is a tendency for the movable valve element 19 to rotate in response to the initial torque developed when the motor is energized, an anti-rotation means 33 is constructed and defined in the valve elements 19 and 20. The movable valve element 19 is provided with a keyway 33K while an anti-rotation element 33S, which may be in the form of a screw, extends through the body of the valve element 20 into the keyway 33K. This construction allows the valve element 19 to be moved linearly up and down as a result of the clearance provided the element 33S in the keyway 33K but prevents the rotation of the valve element 19 due to the presence of the element 33S in the keyway 33K.

From the above-described structure, the operation of the suction valve can now be appreciated. The suction or fluid control valve of the present invention is normally arranged in an open condition and can be closed by the application of a suitable gas to the port 23 of the main valve body 20. Since the normal operating condition of the port 19P is open, it allows the filling of the storage tank through the discharge casing without the necessity of a separate filling pipe. The fluid is taken into the pump suction through the valve ports 19P so as to be operated on by the pump impeller assembly. The fluid will flow into and be exposed to the inducers 18 and pass between the inducer elements and the suction housing 13 to be conveyed through the pump housing 20 by means of the conduit defined between the impeller assembly and the pump housing to flow out of the motor housing assembly through the discharge tube or casing 21.

With the application of the low pressure gas to the port 23, the sliding valve section 19 of the suction valve will be moved upwardly so as to seal off the ports 19P against the main valve body 20 and thereby the communication with the storage tank. When this sealed condition of the ports 19P prevails, the ports 19P do not communicate the suction of the pump and the tank.

The general assembly of the submerged pump as illustrated in FIG. 1 is generally of the type of the prior art construction. The method of retrieving the pump is essentially the same as described in the prior art patents referenced above. The simplicity of the top cover design can be appreciated by examining FIG. 1.

What is claimed is:

1. A cryogenic pump and motor unit adapted for lowering through a cryogenic fluid transmitting conduit to pump cryogenic fluid through the conduit wherein the improvement comprises:

a motor housing of smaller diameter than the conduit, a pump housing arranged with the motor housing and having a discharge outlet surrounding the motor housing to discharge fluid into the conduit around the motor housing, a motor in the motor housing having a shaft extending through said pump housing, impeller means on the motor shaft arranged with the pump housing to pump fluid therethrough to the discharge outlet, valve means for controlling the flow of fluid from outside of the fluid transmitting conduit into the pump housing, the valve means comprising a movable fluid control member having a closed end exposed to the fluid to be pumped and a plurality of side ports arranged close to the bottom end for allowing the fluid to be pumped to pass into the pump housing and a stationary valve member coaxial with the fluid control member and coacting therewith for controlling the flow of the fluid to be pumped into the pump housing in accordance with the relative position of the side ports relative to the stationary valve member, the fluid control member being normally arranged in an open position to allow the fluid to be pumped to pass into the pump housing and movable to a closed position where the ports are sealed off by the stationary valve member thereby preventing the fluid to be pumped to pass into the pump housing, the fluid control member further comprising a cylinder closed at its bottom end and having a flange portion at its upper end, said stationary valve member being constructed and defined to receive the flanged portion of the fluid control member for coaction therewith and having a fluid port for conveying a gas between the coacting surfaces of the valve members whereby the fluid control member is caused to glide up within the stationary valve member in response to the application of a pressurized gas at the fluid port, and pneumatic means for producing relative movement between the valve members.

2. A cryogenic assembly for pumping fluids from cryogenic storage tanks and permitting removal of pumping equipment including a cryogenic single fluid transmitting casing with a cryogenic fluid outlet at the upper portion of the casing wherein the improvement comprises:

a pump and motor unit suspended from adjacent the top of the casing and positioned adjacent the bottom of the casing, the pump and motor unit having a fluid passage, means for lifting the pump and motor unit from the bottom of the casing for retrieving the unit from the storage tank, the casing having valve means arranged adjacent the bottom of the casing for controlling the flow of the stored fluid into the casing and through to the casing fluid outlet and operable between a normally open position and a closed position, said valve means including means for guiding the pump into its proper location centrally of the valve and including a fluid passage in the valve means communicating with the fluid passage in the pump and motor unit to connect the interior of the motor with the inside of the casing for disposing of coolant, lube flow and gas thereby preventing same from being dumped into the cavity of the valve means, and pneumatic means for operating the valve means between its open and closed positions for controlling the flow of stored fluid into the casing and through the fluid outlet.

3. A cryogenic assembly for pumping fluids from cryogenic storage tanks and permitting removal of pumping equipment including a cryogenic single fluid transmitting casing with a cryogenic fluid outlet at the upper portion of the casing wherein the improvement comprises:

a pump and motor unit suspended from adjacent the top of the casing and positioned adjacent the bottom of the casing, means for lifting the pump and motor unit from the bottom of the casing for retrieving the unit from the storage tank, the casing having valve means arranged adjacent the bottom of the casing for controlling the flow of the stored fluid into the casing and through to the casing fluid outlet and operable between a normally open position and a closed position, said valve means including means for guiding the pump into its proper location centrally of the valve, said valve means comprising a fluid control member having a plurality of fluid ports for conveying fluid into the pump and motor unit and a valve body constructed integrally with the casing, one of the valve members being movable relative to the other member for blocking the fluid ports of the fluid control member to seal off the fluid ports and thereby close the valve, the movable fluid control member having a closed end exposed to the fluid to be pumped and a plurality of side ports arranged close to the bottom end for allowing the fluid to be pumped to pass into the pump housing and a stationary valve member coacting therewith for controlling the flow of the fluid to be pumped into the pump housing in accordance with the relative position of the side ports relative to the stationary valve member, the fluid control member further comprising a cylinder closed at its bottom end and having a flange portion at its upper end, said stationary valve member being constructed and defined to receive the flanged portion of the fluid control member for coaction therewith and having a fluid port for conveying a gas between the coacting surfaces of the valve members whereby the fluid control member is caused to glide up within the stationary valve member in response to the application of a pressurized gas at the fluid port, means for conveying a pressurized fluid to the fluid port of the stationary valve member so that pressurized fluids act underneath the flange portion of the fluid control member, the pressurized fluid and the area of the flange portion being constructed and defined to produce a lifting force greater than the static weights of the pump and valve member to move the valve member ports into sealing relationship with the stationary valve member, and pneumatic means for operating the valve means between its open and closed positions for controlling the flow of stored fluid into the casing and through the fluid outlet.

4. An assembly for pumping fluids from storage tanks and permitting removal of pumping equipment as defined in claim 3 including anti-rotation means for preventing relative rotation between the valve members.

5. A cryogenic pump and motor unit adapted for lowering through a cryogenic fluid transmitting conduit to pump cryogenic fluid through the conduit wherein the improvement comprises:

a motor housing of smaller diameter than the conduit, a pump housing arranged with the motor housing and having a discharge outlet surrounding the motor housing to discharge fluid into the conduit around the motor housing, a motor in the motor housing having a shaft extending through said pump housing, impeller means on the motor shaft arranged with the pump housing to pump fluid therethrough to the discharge outlet, valve means for controlling the flow of fluid from outside of the fluid transmitting conduit into the pump housing, the valve means comprising a movable fluid control member having a closed end exposed to the fluid to be pumped and a plurality of side ports arranged close to the bottom end for allowing the fluid to be pumped to pass into the pump housing and a stationary valve member coaxial with the fluid control member and coacting therewith for controlling the flow of the fluid to be pumped into the pump housing in accordance with the relative position of the side ports relative to the stationary valve member, the fluid control member being normally arranged in an open position to allow the fluid to be pumped to pass into the pump housing and movable to a closed position where the ports are sealed off by the stationary valve member thereby preventing the fluid to be pumped to pass into the pump housing, the fluid control member further comprising a keyway to allow the member to be moved between its open and closed positions and the stationary valve member mounts an anti-rotation element extending into the keyway to prevent relative rotation between the valve members upon actuation of the motor, and pneumatic means for producing relative movement between the valve members.

* * * * *